US005195740A

United States Patent [19]

Tsunoda et al.

[11] Patent Number: 5,195,740

[45] Date of Patent: Mar. 23, 1993

[54] NIPPING DEVICE OF A TRANSFER UNIT

[75] Inventors: Arihiro Tsunoda, Higashiosaka; Atsushi Kanou, Amagasaki; Toshiyuki Osaka, Osaka; Toshinobu Katafuchi, Fujiidera; Syuji Yamada, Kobe; Hiroyoshi Omuras, Osaka, all of Japan

[73] Assignee: Mita Industrial Co., Ltd., Osaka, Japan

[21] Appl. No.: 794,587

[22] Filed: Nov. 19, 1991

[30] Foreign Application Priority Data

Nov. 22, 1990 [JP] Japan ..... 2-320038
Nov. 22, 1990 [JP] Japan ..... 2-320040
Mar. 12, 1991 [JP] Japan ..... 3-73882

[51] Int. Cl.[5] ..... B65H 5/12
[52] U.S. Cl. ..... 271/277; 271/82
[58] Field of Search ..... 271/82, 277

[56] References Cited

U.S. PATENT DOCUMENTS 2,593,148 4/1952 Huck .
2,797,097 6/1957 Stobb ..... 271/82
3,221,652 12/1965 Mestre .
3,729,187 4/1973 Waibel ..... 271/82 X

FOREIGN PATENT DOCUMENTS 167861 1/1986 European Pat. Off. .
194549 9/1986 European Pat. Off. .
272802 6/1988 European Pat. Off. .
276185 7/1988 European Pat. Off. .
299645 1/1989 European Pat. Off. .
2097820 3/1972 France .

OTHER PUBLICATIONS

Patent Abstracts of Japan, vol. 12, No. 195 (M-705)(3042), Jun. 7, 1988 and JP-A-63 001 657 (Canon Inc.) Jan. 6, 1988.

*Primary Examiner*—Richard A. Schacher
*Attorney, Agent, or Firm*—Beveridge, DeGrandi, Weilacher & Young

[57] ABSTRACT

A nipping device is provided in a transfer unit having a fixed support and rotating element rotatably supported by the fixed support. The nipping device retains a printing sheet against the circumferential surface of the rotating element, and separates the printing sheet from the transfer unit. The nipping device includes a nipper, a pivoting lever device and a drive device. The nipper is disposed pivotally on the circumferential surface of the rotating element, and retains the feed-leading edge of the printing sheet. The levers of the pivoting lever device are disposed within the rotating element, pivotal on an axes intersecting the circumferential surface of the transfer unit, and functions therein to open and close the nipper by which the printing sheet is nipped against and separated from the transfer unit. The drive device is disposed in the fixed support, and functions to turn the pivoting levers. Due to the structure of this device, it is possible to impel the pivoting levers in a uniform direction by the use of tension springs, and furthermore the setting of the impelling force of the springs to the minimum necessary, is facilitated, such that the load applied to the driving system of the transfer unit can be reduced.

21 Claims, 8 Drawing Sheets

NIPPING DEVICE OF A TRANSFER UNIT

BACKGROUND OF THE INVENTION

The present invention relates to a nipping device, more particularly to a nipping device which retains a printing sheet against the outer surface of a transfer unit, and separates it therefrom as well.

Generally a transfer drum comprising the principal component of a transfer unit is provided opposite a photoconductor drum in a full-color copying machine. A printing sheet is wound onto the circumferential surface of the transfer drum, wherein images developed on the photoconductor drum are transferred onto the printing sheet. The transfer drum is provided with a nipping device which is employed both to wind a printing sheet onto the transfer drum and to separate the printing sheet therefrom.

FIG. 13 shows a conventional nipping device, comprising lift members 71 having their tips inserted under a printing sheet 70, and a nipper 72 employed in conjunction with a stay of the transfer drum (not shown), to retain the printing sheet 70. A rotator shaft 73 is provided along the pivot axis of the lift members 71 and nipper 72, parallel to the axis of the transfer unit drum. Extending radially from the rotator shaft 73, are pins (not shown) which, as the rotator shaft 73 turns, come into lifting contact with the lift members 71 and nipper 72. One end 73*a* of the rotator shaft 73 forms a crank which rides on the outer surface of a cam 74 mounted on a rotator member within the transfer drum. Torsion springs 75 are disposed on the lift members 71 and nipper 72, whereby the lift members 71 and nipper 72 are impelled inward (toward the inside of the transfer drum). The lift members 71, nipper 72, rotator shaft 73 and torsion springs 75 are provided in the rotational element of the transfer unit. Separation claws 76 are fixed to a frame of the copying machine, adjacent to the transfer unit.

In the above-described conventional nipping device, when the rotation transfer drum is in position to nip a printing sheet, the crank portion 73*a* of the rotator shaft 73 riding on the cam 74 is driven to turn the rotator shaft 73 such that the nipper 72 is opened by the adjacent pin, separating from the circumferential surface of the transfer drum. At the point, a printing sheet 70 is fed in between the stay of the transfer drum and the nipper 72 by means of transport rollers, whereupon the nipper 72 is closed to nip the fed end of the printing sheet 70.

When the printing sheet 70 is transported by a transport system which is adjacent to the transfer drum after the image transfer operation is completed, the crank portion 73*a* of the rotating shaft 73 comes into contact with a cam different from the cam corresponding to the sheet nipping position, and the lift members 71 and nipper 72 are raised outward in the same manner as previously described. Consequently, the end of the printing sheet 70 is sufficiently separated from the circumferential surface of the transfer drum, to allow it to catch on the separation claws 76. As the transfer drum rotates further, the printing sheet 70 is transferred along the separation claws 76 to an adjoining transport system.

Since the conventional nipping device as described above employs torsion springs for impelling the lift members and nippers inward, and it is difficult to set and/or regulate the impelling forces of such springs, which must then of necessity be on the overly-powerful side, the drive system of the transfer drum is liable to receive excessive loads. Furthermore, since four sets of mechanisms as shown in FIG. 13 are normally provided in the transfer drum, a total of twelve torsion springs are thus required, and the tendency to excess load on the drive system is multipled.

Due to the fact that the load on the transfer drum drive system stemming from the impelling forces of the torsion springs is abruptly removed when the rotator shaft leaves its corresponding cam and the nippers and related elements are thereby closed, the change in load is of enough consequence to bring about undesirable effects upon the formation of an image therein.

It can also happen that the sides of a printing sheet of given size might not locate properly of the lift members, such that the printing sheet ends are not sufficiently lifted. This in turn can cause the printing sheet to bend up against the separation claws, resulting in a paper jam.

SUMMARY OF THE INVENTION

An object of the present invention is to facilitate the setting of the impellent force of nipping device nippers in a transfer unit and to prevent the application of excess load to the transfer unit drive system.

Another object is to enable the smooth separation of a printing sheet from the transfer unit.

Still another object of the present invention is to prevent abrupt changes in load on the drive system to a transfer unit during the opening and closing operation of a nipping device therein.

A further object is to ensure accuracy in the nipping operation of a transfer unit nipping device.

(1) According to the present invention in one aspect, the nipping device of a transfer unit serves both to retain a printing sheet on the circumferential surface of a rotating element, and to separate it therefrom. The nipping device comprises a nipper mechanism, a pivoting lever element, and a drive cam element.

The nipper mechanism is rotatable and is disposed in the circumferential surface of the rotating element, and retains the leading edge of a printing sheet fed thereto. The pivoting lever element is disposed within the rotating element, and comprises levers which pivot an axes which intersect the circumferential surface of the transfer unit, whereby the nipper mechanism is opened and closed so as to retain the printing sheet against the transfer unit and to separate it therefrom accordingly. The drive cam element comes into pivotal association with the pivoting levers.

The pivoting levers are under the retentive agency of tension springs. In contrast to the conventional device in which the lift and nipping members pivot on an axis parallel to the axis of the transfer drum, it is possible to impel elastically the pivoting levers a direction of uniformity. The tension springs to the pivoting levers facilitates setting the elastic force of the springs to that required to prevent the application of excess load to the driving system of the transfer unit.

(2) A nippng device of a transfer unit according to another aspect retains a printing sheet against the circumferential surface of a rotating element, and separates the printing sheet therefrom. The nipping device includes a plurality of nippers and a plurality of lift regulators.

The nippers are openably disposed on the circumferential surface of the rotating element, and hold the feed-leading edge of a printing sheet. The lift regulators regulate the lift of the nippers away from the outer surface of the rotating device when the nippers are in an open position.

By the opening and closing action of the nippers in this nipping device of the transfer unit, the leading edge of the printing sheet is either nipped against the circumferential surface of the rotating device, or is released therefrom. When the nippers are in the open position, the extent of lift of the nippers away from the circumferential surface of the transfer unit is regulated by the lift regulators.

Since each nipper is independently regulated by the lift regulators, the variance in the lift extent of the nippers necessary to smoothly separate the printing sheet from the rotating device can be effected.

(3) A nipping device of a transfer unit according to still another aspect of the invention retains a printing sheet against the circumferential surface of a rotating element, and separates the printing sheet therefrom. The nipping device includes at least one pair of nipper mechanisms, a pivoting lever device having at least a pair of pivoting levers, and drive cams.

The pivoting levers of the pair each have one end supported by the rotating element pivotally on an axis intersecting the circumferential surface of the rotation device. The remaining ends of the cams face each other, and are driven into positions and apart from each other as they open and close the nipper mechanisms. The drive cams are disposed so as to come into driving contact with the facing ends of the pivoting levers, and are slidable in a direction alongside the rotation axis of the rotating element. The nipper mechanisms are openably disposed on the circumferential surface of the rotating element, and nip the feed-leading edge of a printing sheet.

By the opening and closing action of the nipper mechanisms in this nipping device of a transfer unit, the leading edge of a printing sheet is either nipped, so as to retain the printing sheet on the transfer unit or to separate it therefrom.

The pivoting levers are under the retentive agency of tension springs which can be utilized in the same manner as described above, making it possible to achieve reduction in the load applied to the drive system of the transfer unit.

Since the drive cams are slidable, even if they deviate from the center between the facing ends of the pivoting levers, the positioning of the drive cams is automatically corrected when they come into contact with the corresponding facing ends of the pivoting levers. Thus, accuracy in the nipping operation of this nipping device is ensured.

The foregoing and other objects and advantages of the present invention will be more fully apparent from the following detailed description.

DESCRIPTION OF THE PREFERRED EMBODIMENTS

First Embodiment

Figure 1:
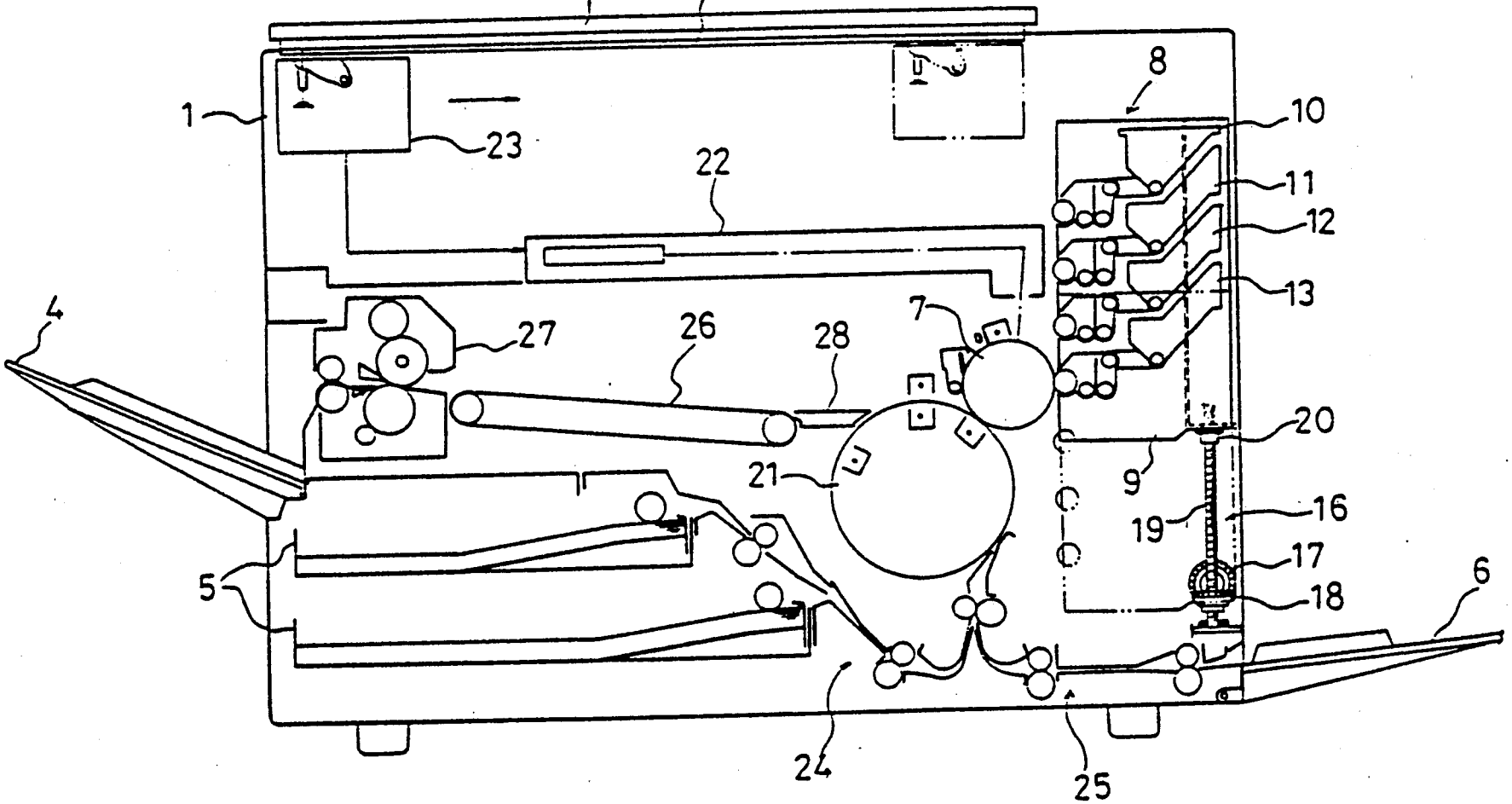
FIG. 1 is a schematic elevational view of a full-color copying machine incorporating an embodiment of the present invention.

FIG. 1 is illustrative of a full-color copying apparatus to which a transfer unit employing a nipping device according to the first embodiment of the present invention may be applied.

For a general understanding therein, reference is made to FIG. 1. An original retainer 2 is disposed in the upper portion of the copying machine body 1, and an original cover 3 is openably mounted on top of the original retainer 2. A copy tray 4 and a plurality of feed cassettes 5 are provided in the left portion of the machine body 1 in the figure, and a bypass feed tray 6 is provided in the right portion thereof.

A photoconductor drum 7 is disposed within the machine body 1. A charger, a transfer unit, a sheet separation device and a cleaning unit, as well as a developing section including vertically arranged developing units 10, 11, 12 and 13, are disposed in the region of the photoconductor drum 7. The developing units consist of magenta developing unit 10, cyan developing unit 11, yellow developing unit 12, and black developing unit 13 in order descending from the uppermost one. These developing units 10 to 13 are supported by a movable frame 9, which is vertically conveyed by means of a moving mechanism 16.

The moving mechanism 16 includes a stepping motor, bevel gears 17 and 18 connected to the stepping motor, a ball screw 19 fixed to the bevel gear 18 and extending vertically, and a nut 20 fixed to the movable frame 9 which mates with the ball screw 19.

A transfer drum 21 is disposed adjacent to the photoconductor drum 7. A laser unit 22 is disposed over the photoconductor drum 7. The laser unit 22 emits a laser beam which is shone upon the upper surface of the photoconductor drum 7. An image reader 23 comprising charge-coupling devices (CCDs) is disposed under the original retainer 2. The image reader 23 is driven to reciprocate horizontally in the figure, so as to scan an original placed on the original retainer 2. The image information thus obtained by the image reader 23 is supplied as an electric signal to the laser unit 22.

Sheet transport paths 24 and 25 are disposed under the transfer drum 21 and between the feed cassette 5 and the bypass feed tray 6. The sheet transport paths 24 and 25 each include feed guides and feed rollers. A discharged-sheet transport system 26 and an image fixing unit 27 are provided between the transfer drum 21 and the copy tray 4. Separation claws 28 for separating a printing sheet from the transfer drum 21, on which it is retained during an image transfer process, are provided between the transfer drum 21 and the discharged-sheet transport system 26.

FIGS. 2 to 5 show the detailed structure of the transfer drum 21. The transfer drum 21 is supported at both ends by rims 30 and 31. A stay 32 couples the two rims 30 and 31. A transfer drum shaft 33 penetrates the centers of the rims 30 and 31, and the ends of the drum shaft 33 are fixed to frames 34 and 35, respectively. The rim 30 is rotatably supported on bearings 37, which are disposed at predetermined intervals along the circumference of the rim 30 and are attached to the frame 34 by means of pins 36. The rim 31 includes hub 31*a*, which is rotatably supported by the drum shaft 33 through bearings 38. A geared portion 31*b* is formed along the circumference of the rim 31, and is in engagement with a corresponding geared portion (not shown) of the photoconductor drum 7.

Figure 3:
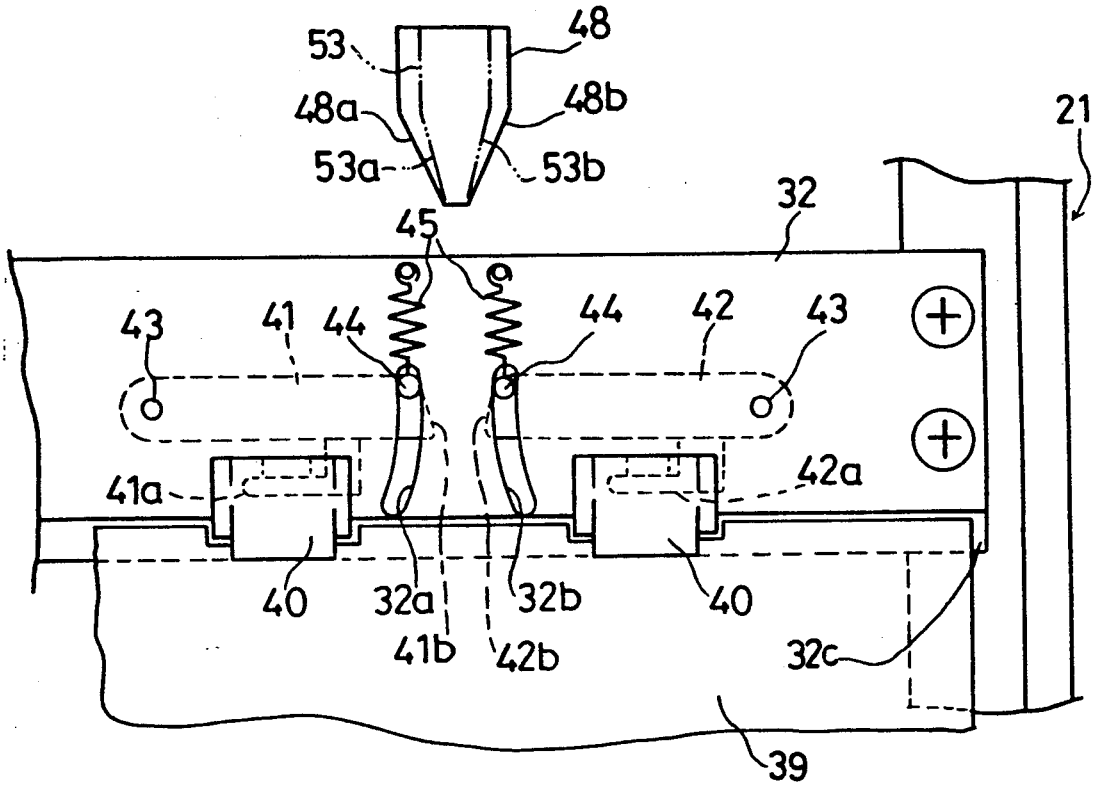
FIG. 3 is an enlarged plan view showing a portion of the transfer unit in detail.

Referring to FIG. 3, nippers 40 are provided on the outer surface of the stay 32, and pivoting levers 41 and 42 are provided on the inner surface of the stay 32. A structure which is the same as that shown in FIG. 3 adjacent to rim 31 is also provided adjacent to rim 30. Thus, a total of four nippers 40 are provided, with pivoting levers corresponding to the respective nippers 40 being provided as well.

Figure 4:
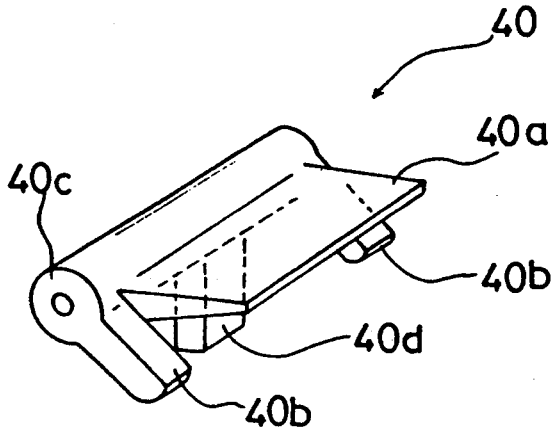
FIG. 4 is a perspective view of a nipper from the transfer unit.

As shown in FIG. 4, each nipper 40 consists of a relatively wide sheet retainer tab 40*a* along its middle portion, sheet lifting portions 40*b* formed at either side of the sheet retainer tab 40*a* and sloping downward from it, and a support portion 40*c* which forms the base of the portions 40*a* and 40*b*. The support portion 40*c* of each nipper 40 is pivotally supported by means of a pin within a notch formed in the stay 32. An engaging portion 40*d* projects from the support portion 40*c* beyond the stay 32 toward the interior of the transfer drum 21.

One end of each of the pivoting levers 41 and 42 is pivotally mounted on the stay 32 through a pin 43. The other ends of the levers 41 and 42 constitute oblique surfaces 41*b* and 42*b* which face each other at a predetermined spacing. Pins 44 projecting outward from the outer surfaces of the levers 41 and 42 are inserted in arced guide slots 32*a* and 32*b* formed in the stay 32. One end of each of tension springs 45 is attached to a corresponding pin 44, wherein the opposite end of each is attached to the stay 32. Accordingly, the pivoting levers 41 and 42 are pivotal on the axes (pins 43) perpendicular to the corresponding tangent to the outer surface of the transfer drum 21. L-shaped catches 41*a* and 42*a* project laterally from each of the pivoting levers 41 and 42. The engaging portions 40*d* of the nippers 40 engage with these portions 41*a* and 42*a*.

In the above-described structure, the nippers 40 are opened and closed by the pivoting of the pivoting levers 41 and 42. Given that the opening angle of the nippers 40 necessary for nipping or separating a printing sheet is $\theta$, the guide slots 32*a* and 32*b* formed in the stay 32 should be of at least the minimum arc length to permit the corresponding opening angle $\theta$. In this embodiment, however, the guide slots 32*a* and 32*b* are of such length as to allow the nippers 40 to open more widely than the angle $\theta$. Thus, if the pivoting levers 41 and 42 are turned through the maximum angle of the slots, the engaging portions 40*d* of the nippers 40 disengage from the catches 41*a* and 42*a* of the pivoting levers 41 and 42, such that they can be set onto the catches 41*a* and 42*a*.

An indentation 32*c* is formed in the lateral edge of the stay 32 along which the nippers 40 are positioned. One end of the transfer drum 21 base material 39 is affixed to the indentation 32*c*, as shown in FIG. 3, while the other end (not shown) is attached to the remaining lateral edge of the stay 32, in which manner the base material 39 is wrapped to form the circumferential surface of the transfer drum 21. The base material 39 has cutouts corresponding to the sheet lifting portions 40*b* of the nippers 40, allowing the sheet lifting portions 40*b* to be movable therethrough.

Figure 2:
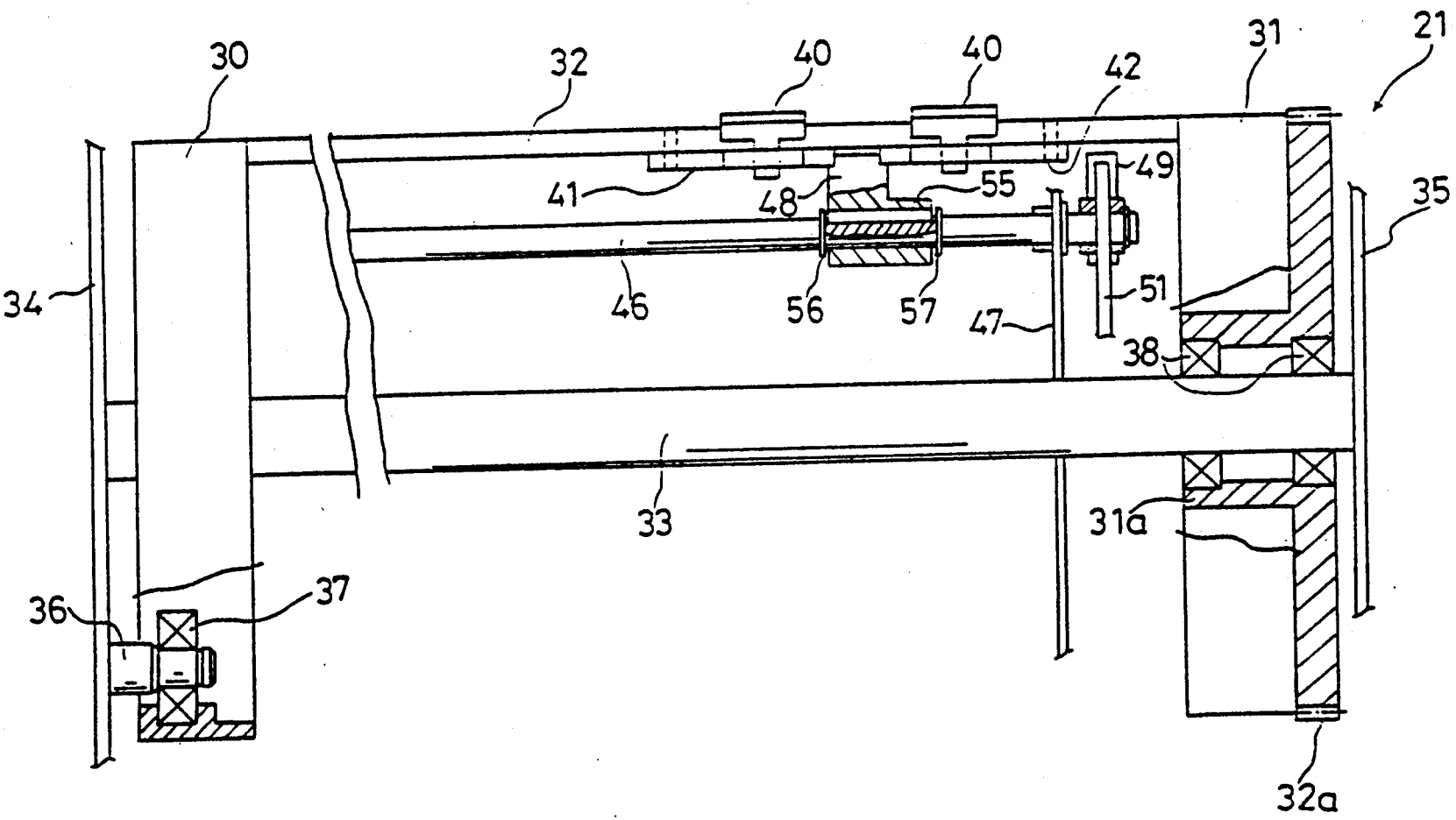
FIG. 2 is a partly in sectional view of a transfer unit according to the embodiment of FIG. 1.
Figure 5:
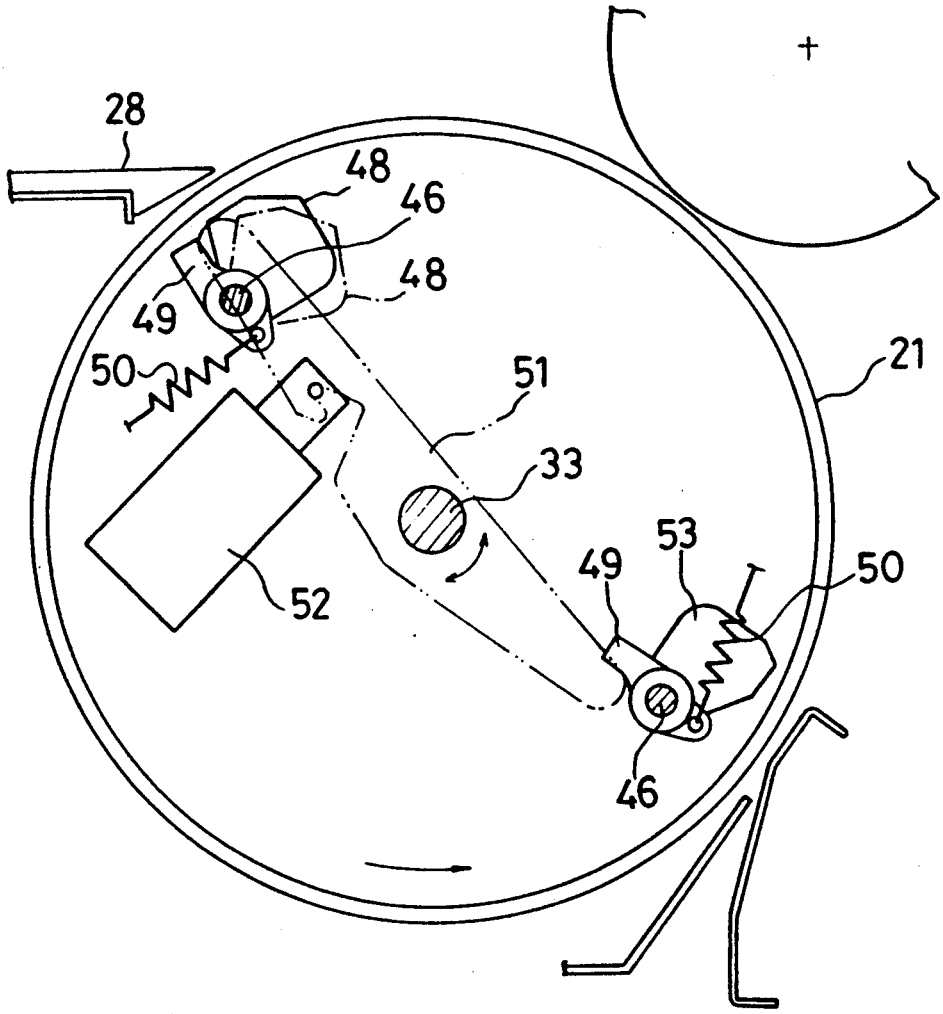
FIG. 5 is an elevational view of an operation control mechanism to the nipper.

FIG. 2 shows one of a pair of rotator shafts 46 provided parallel to the drum shaft 33 inside the transfer drum 21. One rotator shaft 46 is provided to correspond to the printing-sheet nipping position (the lower right region shown in FIG. 5), and the other is opposite thereto (the upper left region in FIG. 5), to correspond to the position in which a printing sheet is separated from the transfer drum 21. These rotator shafts 46 are rotatably supported by a fixed subframe 47 within the transfer drum 21. Drive cams 48 are provided on the upper rotator shaft 46. FIG. 2 shows a mounting key 55 which holds the associated cam 48 against pivoting, yet allows it to slide along the shaft 46. Retaining rings 56 and 57 are provided on either side of each cam 48 on the rotator shaft 46, to provide the cam 48 no more than approximately 1 to 2 mm play in order to compensate vibration or other movement of the shaft 46. On the lateral surfaces of each cam 48 are beveled cam surfaces 48*a* and 48*b*, which come into contact with the corresponding oblique surfaces 41*b* and 42*b* of the pivoting levers 41 and 42, as shown in FIG. 3. A positioning cam 49 is fixed to one end of each of the upper and lower rotator shafts 46 in correspondence. One end of each positioning cam 49 is subject to the force of a tension spring 50, as shown in FIG. 5, such that the opposite ends thereof are held in contact against either end of a rocker arm 51. The rocker arm 51 is pivoted on the drum shaft 33 in the counterclockwise direction in FIG. 5 by the agency of a solenoid 52. By means of the positioning cams 49, springs 50, rocker arm 51 and solenoid 52, the drive cams 48 are movable between an operating position, shown by solid lines in FIG. 5, and a drawn position, indicated by partially dotted lines.

Drive cams 53 are provided on the lower rotator shaft 46, corresponding to the printing-sheet nipping position, and, as shown in FIG. 3, the width of each cam 53 is less than that of each cam 48 provided on the upper rotating shaft 46. The cams 53 are also provided approximately 1 to 2 mm lateral play along the rotator shaft 46, and include beveled cam surfaces 53*a* and 53*b* which come into contact with the oblique surfaces 41*b* and 42*b* of the corresponding ends of the pivoting levers 41 and 42, as is likewise the case with the cams 48.

The operation of this embodiment will now be described.

The execution of a full-color copying operation requires image developing processes by the developing units 10 to 13, each of which entails a corresponding transfer process to the printing sheet, and accordingly the transfer drum 21 must rotate at least four times during the formation of a full-color copy image onto the printing sheet.

When a copy key is pressed, a printing sheet is fed from one of the feed cassettes 5 and is transported to the transfer drum 21 along the sheet transport path 24. A predetermined unit of the developing unit 10 to 13 is moved into developing position. Image information is read from an original placed on the original retainer 2, and a latent image is formed on the photoconductor drum 7 corresponding to the image information. The latent image on the photoconductor drum 7 is subsequently developed by that developing unit which is in the developing position. The developed image is then transferred onto the printing sheet wound onto the transfer drum 21.

With reference now to FIG. 5, the winding of a printing sheet onto the base material 39 of the transfer drum 21 will be described.

When a printing sheet is fed to the transfer drum 21, the solenoid 52 is activated, whereby the rocker arm 51, turning counterclockwise, pivots the positioning cam 49 on the lower end of the rocker arm clockwise, in the tensioning direction of the spring 50. Through linkage on the rotator shaft 46, the drive cams 53 are thus moved toward the outer surface of the transfer drum 21. Subsequently, as the transfer drum 21 rotates counterclockwise as shown in FIG. 5, the oblique surfaces 41*b* and 42*b* of the pivoting levers 41 and 42 are brought into contact with the cam surfaces 53*a* and 53*b* of the drive cams 53. Due to the combined factors of the play provided the cams 53 along the rotator shaft 46, the elastic retention of the pivoting levers 41 and 42, and the bevel of the cam surfaces 53*a* and 53*b*, the cams 53 are brought smoothly into operational adjustment as they come into contact with the oblique surfaces 41*b* and 42*b* of the pivoting levers 41 and 42.

Thereupon, as the oblique surfaces 41*b* and 42*b* are pushed in the tensioning direction of the tension springs 45, the pivoting levers 41 and 42 turn, guided by their pins 44 within the guide slots 32*a* and 32*b* of the stay 32. Thereby the respective side portions within the catches of the pivoting levers push against the engaging portions 40*d* of the nippers 40 which then turn outward, separating from the circumferential surface of the transfer drum 21. The printing sheet then enters between the sheet lifting portions 40*b* and the sheet retainer tabs 40*a* of the nippers 40. As the transfer drum 21 rotates further, the oblique surfaces 41*b* and 42*b* of the pivoting levers 41 and 42 leave the cams 53, and the pivoting levers 41 and 42 return to their initial position as shown in FIG. 3 due to the elastic force of the tension springs 45. Consequently, the catches 41*a* and 42*a* of the pivoting levers 41 and 42 draw the engaging portions 40*d* into the position closing the nippers 40, thereby nipping the printing sheet against the stepped portion 32*c* of the stay 32. Once the printing sheet has been nipped, the solenoid 52 is deactivated, and the lower positioning cam 49 rotates counterclockwise as shown in FIG. 5 due to the return force of the springs 50. In consequence, the drive cam 53 are brought into the drawn position.

Accordingly as described above, the feed-forward end of the printing sheet is retained by the nippers 40, and the printing sheet is wound onto the transfer drum 21. The images developed by the developing units 10 to 13 are then transferred successively onto the printing sheet, after which the printing sheet is separated from the transfer drum 21, and is transported to the discharged-sheet transports system 26.

In order to separate the printing sheet from the transfer drum 21, the solenoid 52 is activated as it likewise is in the afore-described process, whereby the rocker arm 51, turning counterclockwise (according to FIG. 5), pivots the positioning cam 49 under the upper end of the rocker arm counterclockwise, in the tensioning direction of the spring 50. As a result, the drive cams 48 in the drawn position indicated by the partially dotted lines in FIG. 5 move toward the circumferential surface of the transfer drum 21, and are brought into the operating position.

As the transfer drum 21 rotates and the stay 32 passes over the drive cams 48, the pivoting levers 41 and 42 turn in the same manner as described above, such that the nippers 40 turn outward. Since the cams 48 are of greater width than the cams 53, the sheet lifting portions 40*b* on either end of each nipper 40 are accordingly forced to project beyond the base material 39, i.e., the circumferential surface of the transfer drum 21. The play of the drive cams 48 along the rotator shaft 46, during the sheet separating operation ensures herein that, as the cams 48 automatically position themselves, contact with the oblique surfaces 41*b* and 42*b* of the pivoting levers 41 and 42, will be uniform.

The above-described separating operation separates the printing sheet from the circumferential surface of the transfer drum 21, whereupon it id run onto the separation claws 28. As the transfer drum 21 continues to rotate, the printing sheet is guided along the separation claws 28 and is completely separated from the transfer drum 21, whereby it is transported to the discharged-sheet transport system 26.

After the rotating cams 41 and 42 leave the drive cams 48 following the further rotation of the transfer drum 21, the pivoting levers 41 and 42 return to their initial position as shown in FIG. 3 due to the elastic force of the tension springs 45. In consequence, the nippers 40 are brought from the position shown in FIG. 7 back into the position shown in FIG. 6. At the same time, the solenoid 52 is deactivated, whereby the upper positioning cam 49 pivots clockwise under the return force of the spring 50, setting the drive cams 48 into the drawn position.

In the above-described embodiment, the extend to which the nippers 40 open relates directly to the turning angle of the pivoting levers 41 and 42, the optimal degree of nipper 40 opening is readily set by appropriate choice of width of the drive cams 48 and 53. Since the degree of opening of the nippers 40 directly affects both the act of separating the printing sheet from the transfer drum 21, and the load applied to its driving system, precision in the setting of the nipper 40 opening degree improves the separation efficiency and descreases the load applied to the driving system.

The fact that the pivoting levers 41 and 42 pivot on axes transverse to the circumferential surface of the transfer drum 21, allows simple tension springs 45 to be utilized as the means for bringing the nippers 40 into the closed position, and in comparison with conventional apparatuses utilizing torsion springs, it is simpler to set and regulate the returning force of the springs to the minimum required. Consequently, the load applied to the driving system of the transfer drum 21 can be minimized without difficulty.

The sheet retainer tab 40*a* and the sheet lifting portions 40*b* of each nipper 40 in this embodiment are integrally formed, reducing the number of tension springs 45 required for elastically retaining the nippers 40 to four. Thus, by comparison to conventional apparatus employing 12 torsion springs, the consequent load on the driving system of the transfer drum 21 is considerably reduced.

The slidable mounting of the cams 48 amd 53 are on the rotator shafts 46, provides that the pairs of pivoting levers 41 and 42 are, by their simple mechanism, opened and closed evenly, guaranteeing accuracy in the nipping operation. In the conventional art, the drive cams 48 and 53 would generally be fixed to the rotator shafts 46 by means of screws and related elements. Such a conventional method of fixing the drive cams 48 and 53 requires considerable accuracy of assembly and adjustment in order to ensure that they are brought uniformly into contact with the pivoting levers, with resultant higher manufacturing costs and complication of the assembly process. By contrast, according to the present embodiment, since the drive cams 48 and 53 are provided a predetermined degree of lateral plays, they automatically position themselves correctly as they are guided along the oblique surfaces 41*b* and 42*b* of the pivoting levers 41 and 42. Consequently, remote setting of the cams 48 and 53 is not required, and by the fact that they open and close the pair of pivoting levers 41 and 42 evenly, accuracy in the nipping operation is ensured.

Replacement of the base material 39 will now be described.

First, the transfer drum 21 together with the frames 34 and 35 is removed from the machine body 1. Then, the transfer drum 21 is rotated so that the stay 32 is located upward. One end of the base material 39 is detached from the stay 32, and, by rotating the transfer drum 21, the entire base material 39 is removed.

Figure 7:
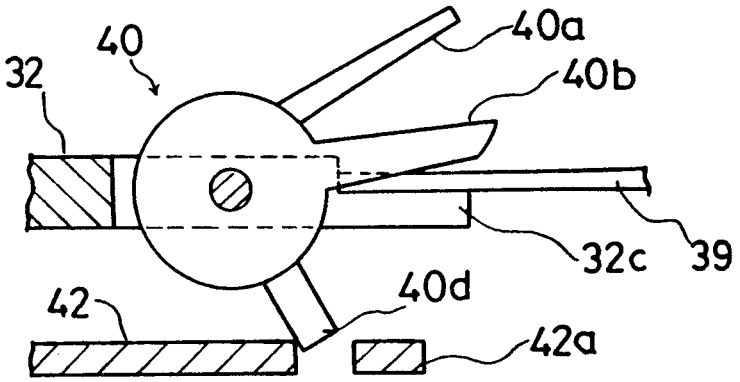
FIG. 7 is a side view of the nipper separating the leading edge of the printing sheet from its stay.
Figure 8:
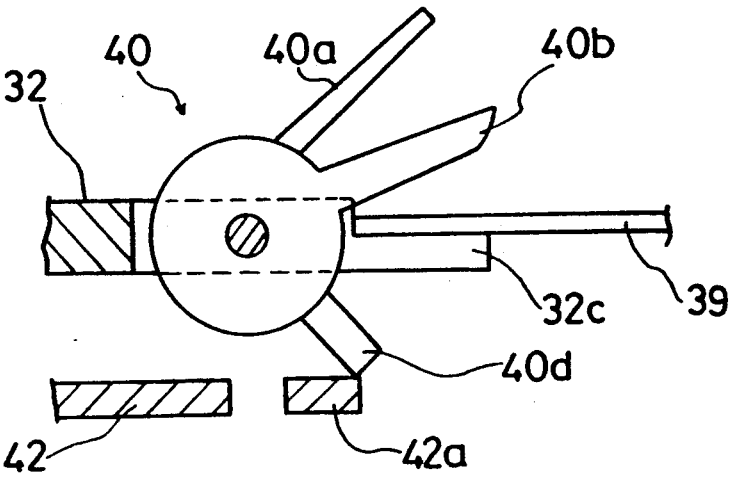
FIG. 8 is a side view of the nipper set into its wide open position.

In order to attach a new piece of base material 39 to the transfer drum 21, the transfer drum 21 is rotated so that the stay 32 is upward in the manner as described above. By working the pins 44 projecting from the outward surfaces of the pivoting levers 41 and 42, the levers 41 and 42 are pivoted such that the nippers 40 turn from the position shown in FIG. 6 through the position shown in FIG. 7, and end in the position in shown in FIG. 8. Therein the nippers are set opened to an angle greater than that of the normal open position (shown in FIG. 7) of the sheet separating operation, and the engaging portions 40*d* of the nippers 40 become detached from the catches 41*a* and 42*a* of the pivoting levers 41 and 42. With the pivoting levers 41 and 42 thus freed and the nippers 40 held wide open, the levers 41 and 42 are pulled back into their initial positions by the agency of the tension springs 45. The engaging portions 40*d* of the nippers 40, having been detached from the catches 41*a* and 42*a* of the pivoting levers 41 and 42, remain resting thereon, as shown in FIG. 8. In this manner, the sheet lifting and retaining elements of the nippers 40 are held wide open, outward from the circumferential surface of the transfer drum 21.

One end of the new base material 39 is inserted under the sheet retainer tabs 40*a* of the nippers 40 and is attached to the stepped portion 32*c* of the stay 32 by adhesive. Then, the transfer drum 21 is rotated once, whereby the base material 39 is wound on, after which the remaining end is attached to the stay 32 by adhesive as well.

Figure 6:
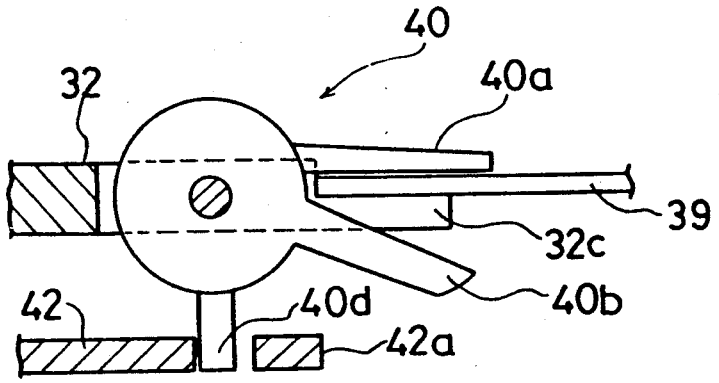
FIG. 6 is a side view of a nipper retaining the leading edge of a printing sheet.

After the new base material 39 has been attached to the transfer drum 21, it is rotated once more so that the stay 32 is located upward, and the pivoting levers 41 and 42 are turned in the above-described manner. The engaging portions 40*d* of the nippers 40 then engage into the catches 41*a* and 42*a* of the pivoting levers 41 and 42, which, as the levers are subsequently returned to their initial positions, sets the nippers 40 into the closed position as shown in FIG. 6.

To reemphasize, in this embodiment, the base material 39 is easily replaced, and without need of mechanical tools, since during replacement the frames 34 and 35 remain attached to the transfer drum 21 and the nippers 40 are propped in the wide-open position.

Second Embodiment

Figure 9:
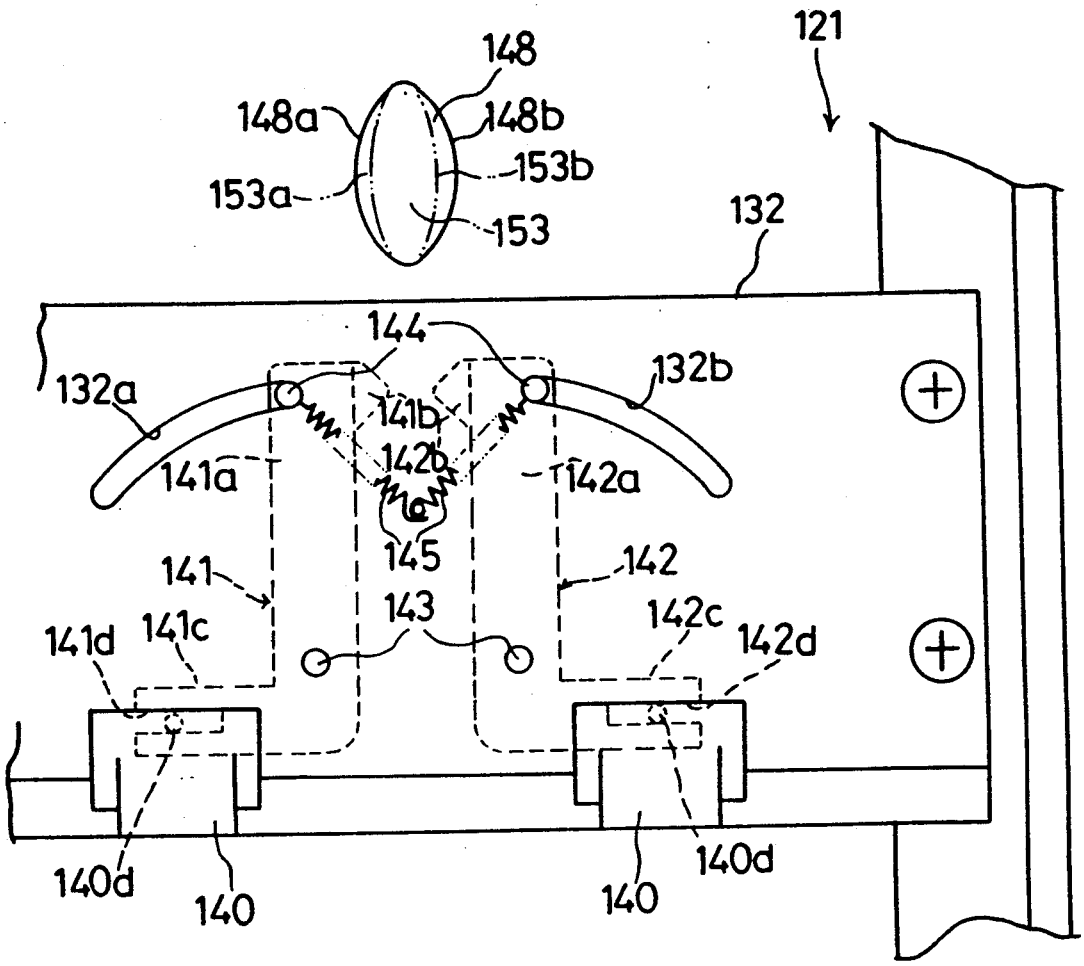
FIG. 9 is an enlarged plan view of showing a detailed portion of a transfer unit according to another embodiment of the invention.
Figure 10:
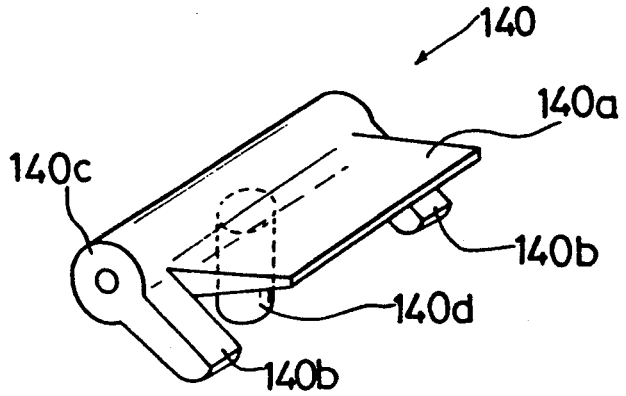
FIG. 10 is a perspective view of a nipper from the embodiment of FIG. 9.

FIGS. 9 and 10 show a nipping device of a transfer unit according to the second embodiment. Nippers 140 are provided on the outer surface of the stay 132, and pivoting levers 141 and 142 are provided on the inner surface thereof. The same structure as shown in FIG. 9 is also provided in a stay on the opposite side. Thus, four nippers 140 are provided, and four pivoting levers corresponding to the nippers 140 are provided.

Each nipper 140 has a relatively wide sheet retainer tab 140*a* in its central portion, and sheet lifting portions 140*b* are provided on either side of the sheet retainer tab 140*a*, as shown in FIG. 10. The sheet lifting portions 140*b* slope inward from the sheet retainer tab 140*a*. A mount portion 140*c* is formed to support these portions 140*a* and 140*b*, and the mount portion 140*c* is supported pivotally by means of a pin and related elements in a notch formed in the stay 132. A cylindrical engaging portion 140*d* projects downward from the lower surface of the support portion 140*c*. The engaging portion 140*d* penetrates the stay 132 and projects inside the transfer drum 121.

The pivoting levers 141 and 142 are disposed symmetrically and each have an L-shaped form consisting of a long portion in line with the drum's rotating direction and a shorter portion at right angles thereto. Each of the levers 141 and 142 is rotatably supported on the stay 132 in the region of its bend by means of a pin 143. Opposed projecting portions 141*b* and 142*b* are formed in respective ends of long portions 141*a* and 142*b* of the levers. Respective ends of short portions 141*c* and 142*c* of the cams have a bifurcate form provided with central notches 141*d* and 142*d*, and the engaging portions 140*d* of the nippers 140 engage in the notches 141*d* and 142*d*. Pins 144 project upward near the projecting portions 141*b* and 142*b* of the pivoting levers 141 and 142, and these pins 144 are inserted in arced guide slots 132*a* and 132*b* in the stay 132. One end of a tension spring 145 is attached to each pin 144 on the outer surface of the stay 132, and the other end of the tension spring 145 is attached to the stay 132.

Thus, the pivoting levers 141 and 142 are pivotal on the corresponding axes (pins 143) which intersect the circumferential surface of the transfer drum 121, and are under the retentive agency of the tension springs 145 such that their projecting portions 141*b* approach each other.

Drive cams 148 and 153 are provided on rotator shafts rotatably supported on a rotator sub frame inside the transfer drum 121. The drive cams 148 and 153 are disposed so as to be able to come into driving contact with the projecting portions 141*b* and 142*b* of the pivoting levers 141 and 142, respectively. Both lateral surfaces 148*a* and 148*b* of the cams 148 and those of the cams 153 are oval surfaces limiting the turning of the pivoting levers 141 and 142. The drive cams 148 provided corresponding to a sheet separating position have a greater width than the cams 153 provided corresponding to a sheet nipping position.

The opening and closing operation of the nippers 140 of the nipping device thus structured will now be described. Wherein the drive cams 153 are located to contact with the pivoting levers 141 and 142, as the transfer drum 121 rotates, the projecting portions 141*b* and 142*b* of the pivoting levers 141 and 142 disposed on the inner surface of the stay 132 are brought into contact with the cam surfaces 153*a* and 153*b* of the cams 153. As a result, the pins 144 of the outer surfaces of the pivoting levers 141 and 142 are guided within the guide slots 132*a* and 132*b* of the stay 132, whereby the cams 141 and 142 rotate in opposition to the return force of the tension springs 145. When the pivoting levers 141 and 142 pivot, the engaging portions 140*d* of the nippers 140 engaged in the notches 141*d* and 142*d* are pushed downward in FIG. 11, whereby the nippers 140 pivot in the direction separating away from the circumferential surface of the transfer drum 121.

As the transfer drum 121 continues to rotate, the projecting portions 141*b* and 142*b* of the rotating cams 141 and 142 pass along the laterally bulging portions of the cam surfaces 153*a* and 153*b* of the cams 153, and gradually approach each other, since the projecting portions 141*b* and 142*b* are urged toward each other under the agency of the tension springs 145. Consequently, the pivoting levers 141 and 142 pivot in the directions opposite to those described above, and the engaging portions 140*d* of the nippers 140 are moved upward in FIG. 11. Then, the nippers 140 pivot in the direction pressing the printing sheet toward the inside of the transfer drum 121.

Since the pivoting actions of the pivoting levers 141 and 142 are graduated along the cam surfaces 153*a* and 153*b* of the drive cams 153, the load applied to the driving system of the transfer drum 121 does not change abruptly. In consequence, improved efficacy of image transfer can be realized, as well as the prevention of unfavorable effects, such as deviation of the color images.

Similarly, when the nippers 140 close, the projectin portions 141*b* and 142*b* of the pivoting levers 141 and 142 are brought into contact with the wider cams 148 such that the pivoting actions of the cams 141 and 142 are graduated. Consequently, the load applied to the driving system of the transfer drum 121 does not change abruptly therein either.

Figure 11:
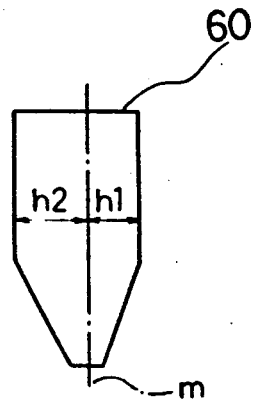
FIG. 11 is a plan view of a drive cam according to a further embodiment of the invention.

MODIFICATIONS (a) In the first embodiment, each of the drive cams 48 has a bisymmetrical form, whereby the nipper nearer center and the nipper toward the support rim in a pair are lifted to the same level. However, drive cams 60 having a form as shown in FIG. 11 may be used so that the nippers can be lifted to different levels. In each cam 60 shown in FIG. 11, a width h1, corresponding to the lift of the nipper located inward, with respect to the center line m is less than a width h2 corresponding to the lift of the nipper located nearer the center. In this case, the cams 60 must be fixed to the rotator shafts 46.

By employing these cams 60, the central nipper can be lifted further than the rimward nippers. Consequently, either side of a printing sheet in certain cases will tend inward, such that they can be easily scooped by the seperation claws 28, and the printing sheet is separated from the drum more efficiently. The rimward nippers are lifted to a lower level, thus making it possible to prevent increase in the load applied to the driving system.

The same modifications are applicable to the second embodiment.

Figure 12:
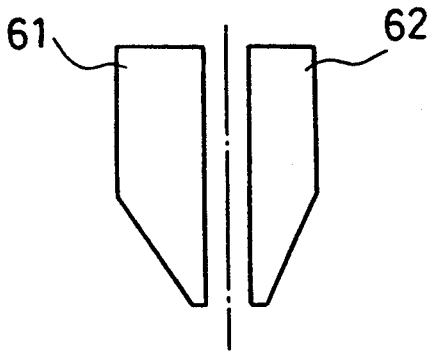
FIG. 12 is a plan view of a drive cam according to a further embodiment of the invention.
Figure 13:
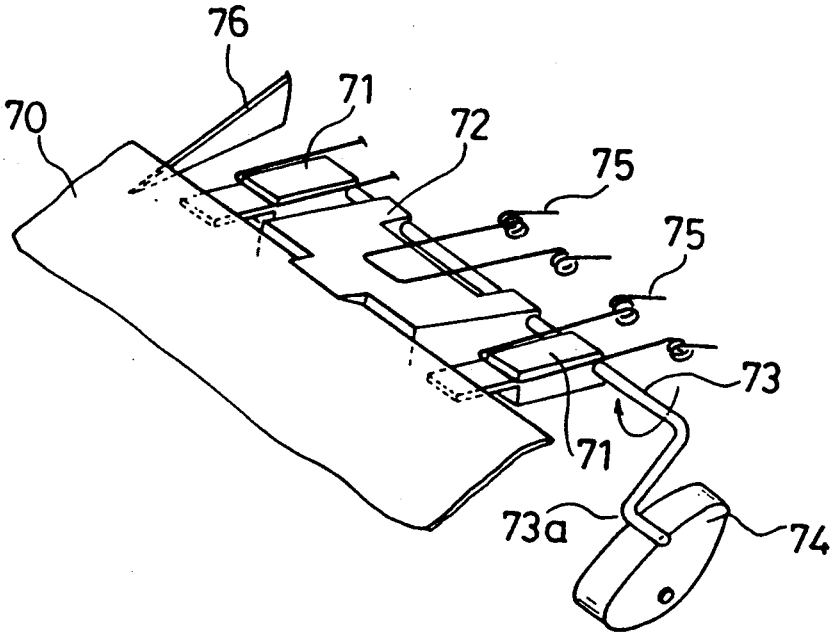
FIG. 13 is a perspective view of a conventional nipping device.

(b) Individual driving cams 61 and 62 may be provided corresponding to the respective nippers of the first embodiment, as shown in FIG. 12. These cams 61 and 62 are fixed immovably to the rotator shafts 46. If these cams have appropriate widths corresponding to the optimum lifts of the nipper, a given printing sheet can be separated from the drum more efficiently, without increasing the load applied to the drive system. The same modifications are applicable to the second embodiment.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A nipping device provided in a transfer unit, wherein the transfer unit includes a fixed portion and a rotating element rotatably supported by said fixed portion, said nipping device being adapted to retain a printing sheet on a circumferential surface of said rotating element and to separate the printing sheet from said rotating element, the nipping device comprising:

nipping means, openably disposed on the circumferential surface of the rotating element, for retaining a leading edge of the printing sheet fed thereto;

a pivoting lever device provided in said rotating element, said pivoting lever device including pivotion levers pivotal on axes intersecting the circumferential surface of said rotating element, and opening and closing said nipping means; and a drive device provided in said fixed portion, for operating said pivoting lever device;

said rotating element including rims of a pair disposed on either end of said transfer unit, and a stay connecting said pair rims and forming a portion of the circumferential surface of said rotating element; wherein said nipping means and said pivoting lever device are attached to said stay;

said pivoting lever device including elastic members by which said pivoting levers close said nipping means;

said drive device including drive cams which come into driving contact with said pivoting levers in the direction opening said nipping means;

wherein said stay includes an arched slot, each of said pivoting levers includes a pin of which one end is inserted into said slot, and said elastic member is a tension spring having one end engaged on said pin and the other end engaged on said stay.

2. A nipping device according to claim 1, wherein each of said pivoting levers has a catch portion, each of said nipping means includes an engaging portion engaging with the catch portion of said pivoting levers, a retainer portion for retaining a printing sheeta against the circumferential surface of said rotating element, and a lift portion for lifting the printing sheet from the circumferential surface of said rotating element.

3. A nipping device according to claim 2, wherein said device device includes a first drive cam disposed to correspond to a sheet nipping position of said transfer unit , and a second drive cam effecting a greater lift of said nipping means than said first drive cam and disposed to correspond to a sheet separating position of said transfer unit.

4. A nipping device provided in a transfer unit, wherein the transfer unit includes a fixed portion and a rotating element rotatably supported by said fixed portion, said nipping device being adapted to retain a printing sheet on a circumferential surface of said rotating element and to separate the printing sheet from said rotating element, the nipping device comprising:

nipping means openably disposed on the circumferential surface of the rotating element, for retaining a leading edge of the printing sheet fed thereto;

a pivoting lever device provided in said rotating element, said pivoting lever device including pivoting levers pivotal on axes intersecting the circumferential surface of said rotating element, and opening and closing said nipping means;

a drive device provided in said fixed portion, for operating said pivoting lever device;

said rotating element including rims of a pair disposed on either end of said transfer unit, and a stay connecting said pair of rims and forming a portion of the circumferential surface of said rotating element;

said nipping means and said pivoting lever device being attached to said stay;

said pivoting lever device including elastic members by which said pivoting levers close said nipping means;

said drive device including drive cams which come into driving contact with said pivoting levers in the direction opening said nipping means;

wherein one end of each of said pivoting levers is pivotally supported by said rotating element and its opposite end serves as a contact end reactive with said drive device to open and close said nipping means, said pivoting levers of said pivoting lever device function in opposed pairs, and said cams of said drive device being disposed so as to be able to come into driving contact with the contact ends of said pivoting levers, and to be slidable along a direction of a rotation axis of said rotating elements.

5. A nipping device according to claim 4, wherein said drive device includes a rotator shaft supporting said drive cams alongside the rotation axis of said rotating element in such a manner that they are slidable yet non-rotatable, and means provided on said rotator shaft for limiting a range of movement of said drive cams.

6. A nipping device provided in a transfer unit, wherein the transfer unit includes a fixed portion and a rotating element rotatably supported by said fixed portion, said nipping device being adapted to retain a printing sheet on a circumferential surface of said rotating element and to separate the printing sheet from said rotating element, the nipping device comprising:

nipping means openably disposed on the circumferential surface of the rotating element, for retaining a leading edge of the printing sheet fed thereto;

a pivoting lever device provided in said rotating element, said pivoting lever device including pivoting levers pivotal on axes intersecting the circumferential surface of said rotating element, and opening and closing said nipping means;

a drive device provided in said fixed portion, for operating said pivoting lever device;

said rotating element including rims of a pair disposed on either end of said transfer unit, and a stay connecting said pair of rims and forming a portion of the circumferential surface of said rotating element;

said nipping means and said pivoting lever device being attached to said stay;

said pivoting lever device including elastic members by which said pivoting levers close said nipping means;

said drive device including drive cams which come into driving contact with said pivoting levers in the direction opening said nipping means;

said drive cams each having cam surfaces which drive the opening and closing of said nipping means;

wherein the cam surfaces of said drive cams cause the nipping means to lift either ends of the printing sheet on said rotating element by an amount less than that of the sheet portion along a middle of said rotating element.

7. A nipping device provided in a transfer unit, wherein the transfer unit includes a fixed portion and a rotating element rotatably supported by said fixed portion, said nipping device being adapted to retain a printing sheet on a circumferential surface of said rotating element and to separate the printing sheet from said rotating element, the nipping device comprising:

nipping means openably disposed on the circumferential surface of the rotating element, for retaining a leading edge of the printing sheet fed thereto;

a pivoting lever device provided in said rotating element, said pivoting lever device including pivoting levers pivotal on axes intersecting the circumferential surface of said rotating element, and opening and closing said nipping means;

a drive device provided in said fixed portion, for operating said pivoting lever device;

said rotating element including rims of a pair disposed on either end of said transfer unit, and a stay connecting said pair of rims and forming a portion of the circumferential surface of said rotating element;

said nipping means and said pivoting lever device being attached to said stay;

said pivoting lever device including elastic members by which said pivoting levers close said nipping means;

said drive device including drive cams which come into driving contact with said pivoting levers in the direction opening said nipping means;

positioning means for moving said drive cams between an operating position in which said cams come into contact with said pivoting levers so as to turn them, and a drawn position in which said drive cams are withdrawn from the region of driving contact with said pivoting levers.

8. A nipping device according to claim 7, wherein said drive device includes a drive cam disposed in a sheet nipping position of said transfer unit, and a drive cam disposed in a sheet separating position of said transfer unit.

9. A nipping device provided in a transfer unit, wherein the transfer unit includes a fixed portion and a rotating element rotatably supported by said fixed portion, said nipping device being adapted to retain a printing sheet on a circumferential surface of said rotating element and to separate the printing sheet from said rotating element, the nipping device comprising:

nipping means openably disposed on the circumferential surface of the rotating element, for retaining a leading edge of the printing sheet fed thereto;

a pivoting lever device provided in said rotating element, said pivoting lever device including pivoting levers pivotal on axes intersecting the circumferential surface of said rotating element, and opening and closing said nipping means;

a drive device provided in said fixed portion, for operating said pivoting lever device;

said rotating element including rims of a pair disposed on either end of said transfer unit, and a stay connecting said pair of rims and forming a portion of the circumferential surface of said rotating element;

said nipping means and said pivoting lever device being attached to said stay;

said pivoting lever device including elastic members by which said pivoting levers close said nipping means;

said drive device including drive cams which come into driving contact with said pivoting levers in the direction opening said nipping means;

wherein one end of each of said pivoting levers is pivotally supported by said rotating element and its opposite end serves as a reactive contact end, said pivoting levers of said pivoting lever device function in opposed pairs, and said drive device includes a drive cam having cam surfaces which come into driving contact with the contact ends of said pivoting levers such that a varying extent of lift is effected to a printing sheet.

10. A nipping device according to claim 9, wherein the lift extent effected by the surfaces of said drive device nearer the middle of said rotating element is greater than the lift extent effected by the other cam surfaces therein.

11. A nipping device provided in a transfer unit, wherein the transfer unit includes a fixed portion and a rotating element rotatably supported by said fixed portion, said nipping device being adapted to retain a printing sheet on a cicumferential surface of said rotating element and to separate the printing sheet from said rotating element, the nipping device comprising:

nipping means openably disposed on the circumferential surface of the rotating element, for retaining a leading edge of the printing sheet fed thereto;

a pivoting lever device provided in said rotating element, said pivoting lever device including pivoting levers pivotal on axes intersecting the circumferential surface of said rotating element, and opening and closing said nipping means;

a drive device provided in said fixed portion, for operating said pivoting lever device;

said rotating element including rims of a pair disposed on either end of said transfer unit, and a stay connecting said pair of rims and forming a portion of the circumferential surface of said rotating element;

said nipping means and said pivoting lever device being attached to said stay;

a base material attached to said rotating element, and constituting the circumferential surface of said transfer unit, said sheet being replaceable, wherein said nipping means includes a retainer for retaining said printing sheet against a surface of said base material, and said pivoting lever device is capable of propping said nipping means, wherein said retainer is opened sufficiently outward from the circumferential surface of said transfer unit;

wherein said pivoting lever has a catch portion, and said nipping means includes an engaging portion engaged with said catch portion, a retainer for retaining the printing sheet on the circumferential surface of said rotating element, and a lift portion for lifting a printing sheet from the circumferential surface of said rotating element.

12. A nipping device according to claim 11, wherein said pivoting lever device includes a portion on which the engaging portion of said nipping means can ride.

13. A nipping device provided in a transfer unit, the transfer unit including a fixed portion and a rotating element rotatably supported by said fixed portion, said nipping device being adapted to retain a printing sheet on a circumferential surface of said rotating element and to separate the printing sheet from said rotating element, said nipping device comprising:

a plurality of nippers openably disposed on the circumferential surface of said rotating element, for retaining a leading edge of the printing sheet fed thereto;

a plurality of lift regulators regulating the extent of the lift of said nippers into an open position away from the circumferential surface of said rotating element;

wherein said rotating element includes rims of a pair disposed on either end of said transfer unit, and a stay connecting said pair of rims and forming a portion of the circumferential surface of said rotating element;

said plurality of nippers being mounted to said stay;

wherein said plurality of lift regulators includes a pivoting lever device having a plurality of pivoting levers rotational on axes which intercept the circumferential surface of said rotating element, by which said plurality of nippers are opened and closed, and a drive device having drive cams which come into driving contact with said pivoting levers, so as to turn them;

said pivoting lever device including a plurality of elastic members by which said plurality of pivoting levers close said nippers;

said drive device turns said plurality of pivoting levers such that they open said nippers;

wherein said stay includes arced slots, said pivoting lever device includes pins having tips which are inserted into said slots, and each of said elastic members is a tension spring having one end engaged on said pin and the other end engaged on said stay.

14. A nipping device provided in a transfer unit, the transfer unit including a fixed portion and a rotating element rotatably supported by said fixed portion, said nipping device being adapted to retain a printing sheet on a circumferential surface of said rotating element and to separate the printing sheet from said rotating element, said nipping device comprising:

a plurality of nippers openably disposed on the circumferential surface of said rotating element, for retaining a leading edge of the printing sheet fed thereto;

a plurality of lift regulators regulating the extent of the lift of said nippers into an open position away from the circumferential surface of said rotating element;

wherein said rotating element includes rims of a pair disposed on either end of said transfer unit, and a stay connecting said pair of rims and forming a portion of the circumferential surface of said rotating element;

said plurality of nippers being mounted to said stay;

wherein said plurality of lift regulators includes a pivoting lever device having a plurality of pivoting levers rotational on axes which intercept the circumferential surface of said rotating element, by which said plurality of nippers is opened and closed, and a drive device having drive cams which come into driving contact with said pivoting levers, so as to turn them;

said pivoting lever device including a plurality of elastic members by which said plurality of pivoting levers close said nippers, said drive device turns said plurality of pivoting levers such that they open the nippers;

wherein said drive cams are slidable alongside a rotation axis of said rotating element; and a group of pivoting levers among said plurality of pivoting levers of which one end of each therein is rotatably supported by said rotating element, the opposite ends therein serving to come into reactive contact with both lateral surfaces of one of said drive cams.

15. A nipping device according to claim 14, wherein said drive device includes a rotator shaft alongside the rotation axis of said rotating element supporting said drive cams in such a manner as to be slidable yet non-rotatable, and means provided on said rotator shaft for limiting the range of movement of said drive cams.

16. A nipping device provided in a transfer unit, the transfer unit including a fixed portion and a rotating element rotatably supported by said fixed portion, said nipping device being adapted to retain a printing sheet on a circumferential surface of said rotating element and to separate the printing sheet from said rotating element, said nipping device comprising:

a plurality of nippers openably disposed on the circumferential surface of said rotating element, for retaining a leading edge of the printing sheet fed thereto;

a plurality of lift regulators regulating the extent of the lift of said nippers into an open position away from the circumferential surface of said rotating element;

wherein said rotating element includes rims of a pair disposed on either end of said transfer unit, and a stay connecting said pair of rims and forming a portion of the circumferential surface of said rotating element;

said plurality of nippers being mounted to said stay;

wherein said plurality of lift regulators includes a pivoting lever device having a plurality of pivoting levers rotational on axes which intercept the circumferential surface of said rotating element, by which said plurality of nippers is opened and closed, and a drive device having drive cams which come into driving contact with said pivoting levers, so as to turn them;

said pivoting lever device including a plurality of elastic members by which said plurality of pivoting levers close said nippers;

said drive device turns said plurality of pivoting levers such that they open said nippers;

wherein two of said plurality of pivoting levers have ends rotatably supported by said rotating device, while the opposite ends serve as contact ends reactive with said drive device to open and close said nippers, and each said drive cam is disposed so as to be able to come into driving contact with the contact ends of said two pivoting levers, and has a pair of cam surfaces effecting different degrees of lift along the printing sheet.

17. A nipping device according to claim 16, wherein the extent of lift effected by the surfaces of said drive cam device nearer the middle of said rotating element is greater than the extent of lift effected by the other cam surfaces therein.

18. A nipping device provided in a transfer unit, the transfer unit including a fixed portion and a rotating element rotatably supported by said fixed portion, said nipping device being adapted to retain a printing sheet on a circumferential surface of said rotating element and to separate the printing sheet from said rotating element, said nipping device comprising:

a plurality of nippers openably disposed on the circumferential surface of said rotating element, for retaining a leading edge of the printing sheet fed thereto;

a plurality of lift regulators regulating the extent of the lift of said nippers into an open position away from the circumferential surface of said rotating element;

wherein said rotating element includes rims of a pair disposed on either end of said transfer unit, and a stay connecting said pair of rims and forming a portion of the circumferential surface of said rotating element;

said plurality of nippers being mounted to said stay;

wherein said plurality of lift regulators includes a pivoting lever device having a plurality of pivoting levers rotational on axes which intercept the circumferential surface of said rotating element, by which said plurality of nippers is opened and closed, and a drive device having drive cams which come into driving contact with said pivoting levers, so as to turn them;

said pivoting lever device including a plurality of elastic members by which said plurality of pivoting levers close said nippers;

said drive device turns said plurality of pivoting levers such that they open said nippers;

positioning means for moving each of said drive cams between an operating position in which said cams come into contact with the associated pivoting levers so as to turn said pivoting levers, and a drawn position in which said drive cams are withdrawn from a region of driving contact with said pivoting levers.

19. A nipping device according to claim 18, wherein said drive device includes a first drive cam disposed in a printing sheet nipping position of said transfer unit, and a second drive cam disposed in a printing sheet separating position of said transfer unit.

20. A nipping device provided in a transfer unit, the transfer unit including a fixed portion and a rotating element rotatably supported by said fixed portion, said nipping device being adapted to retain a printing sheet on an external circumferential surface of said rotating element and to separate the printing sheet from said rotating element, said nipping device comprising:

nipping means openably disposed on the circumferential surface of said rotating element, for retaining a leading edge of the printing sheet fed thereto;

means provided in said rotating element for opening and closing said nipping means;

a drive device provided in said fixed portion for operating said nipping means opening and closing means, wherein said nipping means opening and closing means includes pivoting levers and elastic members, by which said pivoting levers close said nipping means, said drive device includes drive cams which come into driving contact with said pivoting levers in a direction opening said nipping means;

wherein said rotating element includes rims of a pair disposed on either end of said transfer unit, and a stay connecting said pair of rims and forming a portion of the circumferential surface of said rotating element;

said nipping means and said nipping means opening and closing means being mounted to said stay, wherein said stay includes arced slots, said pivoting levers include pins having tips which are inserted into said slots, and said elastic member is a tension spring having one end engaged on said pin and the other end engaged on said stay.

21. A nipping device according to claim 20, wherein said pivoting levers have a catch portion, and said nipping means includes an engaging portion engaging with said catch portion of said pivoting lever, a retainer for retaining the printing sheet against the circumferential surface of said rotating element, and a lift portion for lifting the printing sheet from the circumferential surface of said rotating element.

* * * * *